US009863639B2

(12) United States Patent
Huang et al.

(10) Patent No.: US 9,863,639 B2
(45) Date of Patent: Jan. 9, 2018

(54) METHOD FOR CONTROLLING GAS-FIRED APPLIANCE

(71) Applicant: Grand Mate, Co., Ltd., Taichung (TW)

(72) Inventors: Chung-Chin Huang, Taichung (TW); Chin-Ying Huang, Taichung (TW); Hsin-Ming Huang, Taichung (TW); Hsing-Hsiung Huang, Taichung (TW); Yen-Jen Yeh, Taichung (TW)

(73) Assignee: Grand Mate, Co., Ltd., Taichung (TW)

( * ) Notice: Subject to any disclaimer, the term of this patent is extended or adjusted under 35 U.S.C. 154(b) by 271 days.

(21) Appl. No.: 14/839,737

(22) Filed: Aug. 28, 2015

(65) Prior Publication Data

US 2017/0059170 A1 Mar. 2, 2017

(51) Int. Cl.
*F23N 1/00* (2006.01)
*F24C 3/12* (2006.01)

(52) U.S. Cl.
CPC ..... *F24C 3/122* (2013.01); *F23N 1/002* (2013.01); *F23N 1/005* (2013.01); *F23N 2031/02* (2013.01); *F23N 2031/04* (2013.01); *F23N 2035/14* (2013.01); *F23N 2035/16* (2013.01); *F23N 2035/18* (2013.01)

(58) Field of Classification Search
CPC ..... F24C 3/122
USPC ..... 431/12, 126
See application file for complete search history.

(56) References Cited

U.S. PATENT DOCUMENTS 5,363,651 A * 11/1994 Knight ..... F02B 71/045 123/152
5,588,464 A * 12/1996 Tylosky ..... F16K 17/042 137/613
8,770,185 B2 * 7/2014 Huang ..... F24B 1/1808 126/116 A

* cited by examiner

*Primary Examiner* — Avinash Savani
(74) *Attorney, Agent, or Firm* — Lynette Wylie; Apex Juris, pllc.

(57) ABSTRACT

A method for controlling a gas-fired appliance is presented, wherein the gas-fired appliance includes a combustor, at least one flow-regulating valve, and a solenoid valve which are all interconnected, and adaptive to low or no power supplied to the gas-fired appliances, including the steps of: using the solenoid valve to block fuel gas, determining whether the power returns to normal, and if not, maintaining the solenoid valve block, and if so, closing the flow-regulating valve to thereby block the fuel gas such that the fuel gas flow is paused when the solenoid valve is open during a next ignition try.

7 Claims, 4 Drawing Sheets

METHOD FOR CONTROLLING GAS-FIRED APPLIANCE

BACKGROUND OF THE INVENTION

1. Technical Field

The present invention relates to control supply of fuel gas, and more particularly to a method for controlling fuel gas flow to a gas-fired appliance during power surges or outages.

2. Description of Related Art

A gas-fired appliance heats objects with flame generated by burning combustible gas. A traditional gas-fired appliance comprises a combustor and a manual regulating valve, wherein the combustor burns fuel gas, and the manual regulating valve can be used to manually adjust the flow of fuel gas supplied to the combustor. For precise flow control, an advanced gas-fired appliance uses a proportional valve instead of the manual regulating valve to control the flow. Particularly, the flow of the fuel gas is precisely controlled by adjusting the current passing through the coil of the proportional valve.

While such a proportional valve may provide precise flow control, it requires continuous power supply to the coil even for constant flow output only, which increases power consumption. For this problem, a solution has been proposed that uses a motor-controlled flow-regulating valve together with a solenoid valve to replace the foregoing proportional valve, wherein a controller controls the motor of the flow-regulating valve to drive a valve plug to close the valve opening of the flow-regulating valve as required, so as to change the flow, and the solenoid valve serves to allow or disallow the fuel gas to pass the valve. Whereby, after the fuel gas output by the flow-regulating valve is adjusted to a desired flow, even if the motor is unpowered, the constant flow can still be maintained. In addition, since the solenoid valve consumes less power than the proportional valve does, the benefit of saving energy can be achieved.

When the power supplied to the gas-fired appliance is cut off, the controller loses the power and is not able to control the motor, so the valve opening of the flow-regulating valve remains open. At this time, the solenoid valve stops the fuel gas, so as to prevent more supply of the fuel gas to the combustor. However, after power restoration, the controller has no way to know how much the valve opening of the flow-regulating valve is open, which increases the difficulty of subsequent control. In addition, after power restoration, the fuel gas will immediately arrive at the combustor as soon as the solenoid valve is open, and may dangerously leak out if the fire is not immediately ignited.

BRIEF SUMMARY OF THE INVENTION

The primary objective of the present invention is to provide a method for controlling a gas-fired appliance, which featuring closing the valve opening of a flow-regulating valve after power restoration.

To achieve the objective of the present invention, the present invention discloses the method for controlling a gas-fired appliance, which includes a combustor, at least one flow-regulating valve and a solenoid valve, wherein the at least one flow-regulating valve and the solenoid valve are installed on a pipeline that communicates with the combustor and serves to introduce fuel gas; each of the at least one flow-regulating valve has a valve body, a valve plug, and a motor, wherein the valve body has a valve opening for the fuel gas to pass therethrough, and the valve plug is driven by the motor to change a degree of openness of the valve opening; the solenoid valve is controllable to allow or disallow the fuel gas to pass therethrough; the gas-fired appliance further includes a power source for powering the motor. The disclosed method for controlling the gas-fired appliance is to be performed after the power source stops supplying power, and comprises the steps of: A. using the solenoid valve to block the fuel gas from passing therethrough; and B. when the power source starts to supply the power again, controlling the motor to make the valve plug close the valve opening.

The present invention further provides a method for controlling a gas-fired appliance, which includes a combustor, at least one flow-regulating valve, and a solenoid valve, wherein the at least one flow-regulating valve and the solenoid valve are installed on a pipeline that communicates with the combustor and serves to introduce fuel gas; each of the at least one flow-regulating valve has a valve opening, a valve plug, and a motor, wherein the valve opening allows the fuel gas to pass therethrough, and the valve plug is driven by the motor to change a degree of openness of the valve opening; the solenoid valve is controllable to allow or disallow the fuel gas to pass therethrough; the gas-fired appliance further includes a power source for powering the motor. the disclosed method for controlling the gas-fired appliance comprises the steps of: A. when power supplied by the power source is below a predetermined voltage, making the solenoid valve block the fuel gas from passing therethrough; B. determining whether the power supplied by the power source becomes higher than the predetermined voltage again, and if so, controlling the motor to make the valve plug close the valve opening; if not so, keeping making the solenoid valve block the fuel gas from passing therethrough; and C. repeating Step B until the valve plug closes the valve opening.

A benefit of the present invention is that when the power provided by the power source resumes following power surges or outages when the supply falls below a predetermined minimum voltage, it is ensured that the flow-regulating valve well blocks the fuel gas, so that when the solenoid valve is open during a next ignition try, the fuel gas is prevented from flowing to the combustor immediately.

BRIEF DESCRIPTION OF THE SEVERAL VIEWS OF THE DRAWINGS

The structure as well as a preferred mode of use, further objects, and advantages of the present invention will be best understood by referring to the following detailed description of some illustrative embodiments in conjunction with the accompanying drawings, in which.

DETAILED DESCRIPTION OF THE INVENTION

The present invention is best understood by reference to the following detailed description of illustrative embodiments when read in conjunction with the accompanying drawings clarifying its modes of use, as well as, objectives and advantages.

Figure 1:
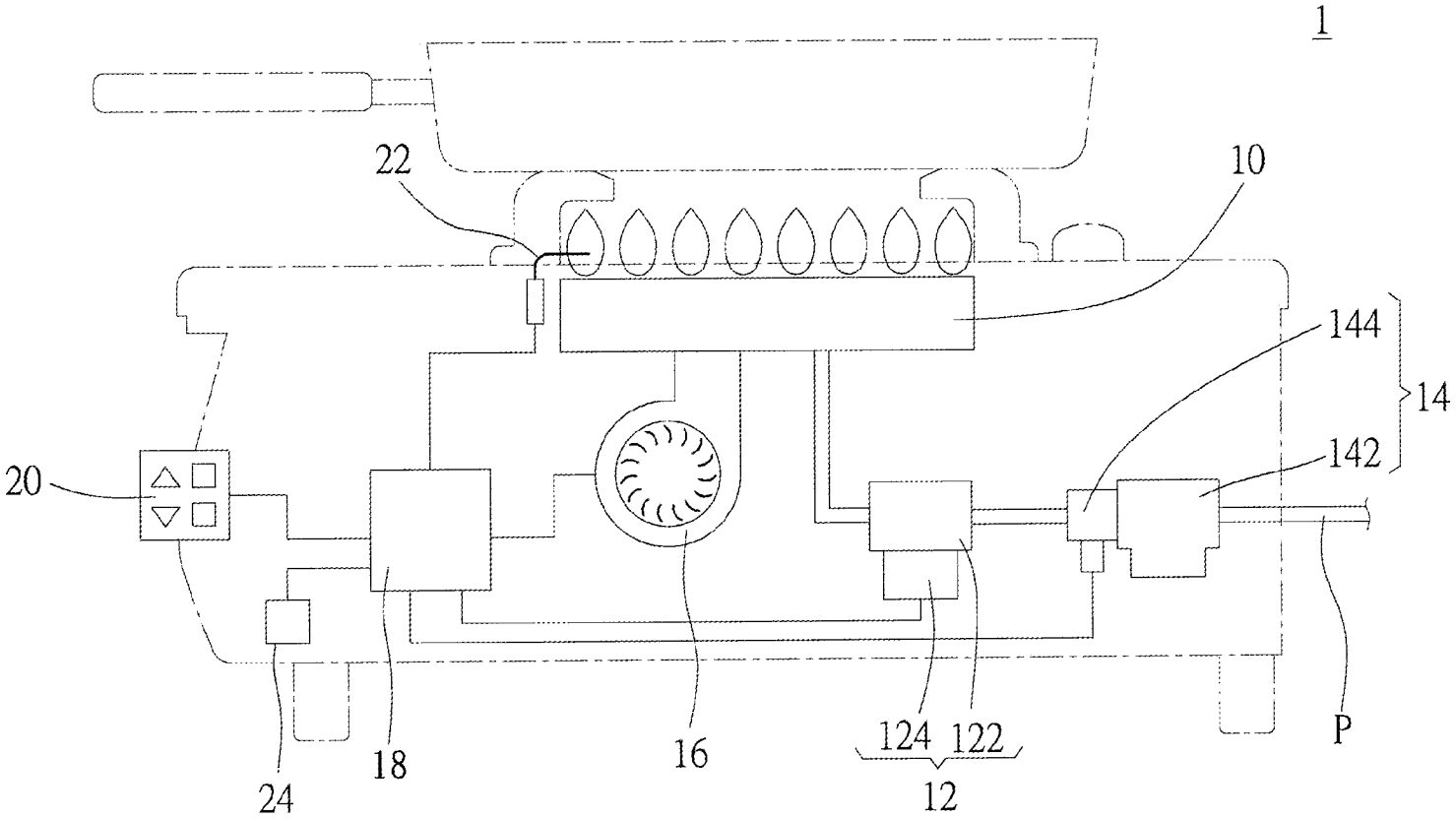
FIG. 1 is a schematic drawing showing the gas-fired appliance according to a first preferred embodiment of the present invention.

FIG. 1 is a schematic drawing showing a gas-fired appliance according to a first preferred embodiment of the present invention. In the present embodiment, the gas-fired appliance is a gas stove 1, which comprises a combustor 10, a flow-regulating valve 12, a pressure regulator 14, a blower 16, and a controller 18 all contained in a housing.

Figure 2:
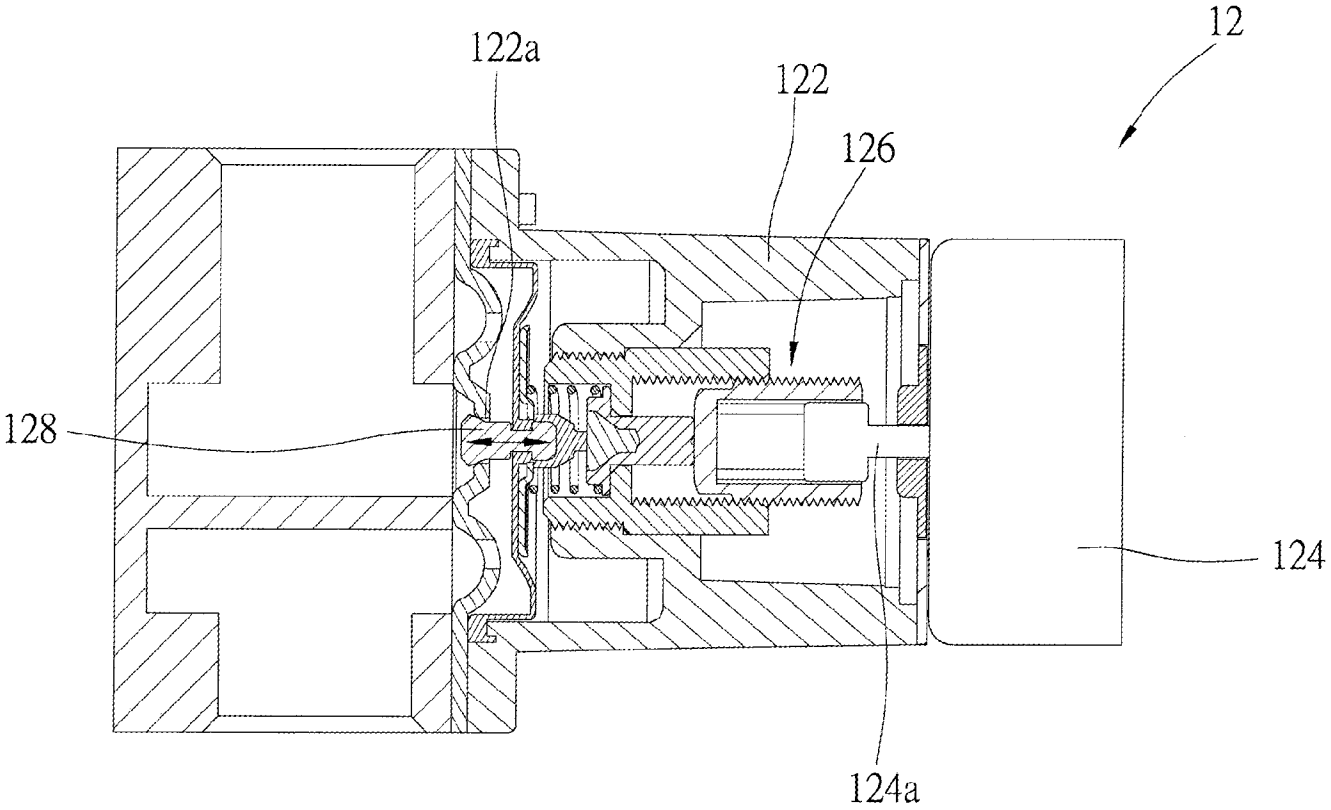
FIG. 2 is a schematic drawing showing the flow-regulating valve according to the first preferred embodiment of the present invention.

The combustor 10 communicates with a pipeline P, and is used to burn fuel gas, such as natural gas, to generate flame. As shown in FIG. 2, the flow-regulating valve 12 has a valve body 122 and a step motor 124. The valve body 122 is installed in the route of the pipeline P. The valve body 122 has a valve opening 122*a* that allows fuel gas to pass therethrough. The step motor 124 has its rotating shaft 124*a* connected to a valve plug 128 through a connecting mechanism 126. The step motor 124 receives pulse signals to drive the valve plug 128 to shift in the valve opening 122*a*, so as to change a degree of openness of the valve opening 122*a*, thereby adjusting the flow of the fuel gas. The step motor 124 receives a predetermined number of pulse signals, so as to drive the valve plug 128 to make the degree of openness of the valve opening 122*a* change from where the valve opening 122*a* is fully open to where the valve opening 122*a* is closed.

The pressure regulator 14 is also installed in the route of the pipeline P. The pressure regulator 14 has a regulating valve 142 and a solenoid valve 144 that are mutually connected. The regulating valve 142 serves to lower the pressure of the fuel gas and to output the fuel gas to the solenoid valve 144. The solenoid valve 144 is a normally closed solenoid valve. When receiving a high-level electric signal, the solenoid valve 144 is opened to allow the fuel gas to pass therethrough. When not receiving the electric signal, the solenoid valve 144 automatically blocks the fuel gas.

The blower 16 communicates with the combustor 10, and is controllable to change the rotational speed of its motor, so as to change the air volume it sends into the combustor 10.

The controller 18 is electrically connected to a control panel 20 and an ignition sensor pin 22, wherein the controller 18 is electrically connected to the step motor 124, the solenoid valve 144, and the blower 16 as well. The control panel 20 is for a user to operate so as to activate functions such as ignition, firepower adjustment and turning off fire. The controller 18 is electrically connected to a power source 24. The power source 24 powers the controller 18, and the power source 24 also powers the control panel 20, the ignition sensor pin 22, the step motor 124, the solenoid valve 144, and the blower 16. In the present embodiment, the power source 24 is a battery. In other embodiments, it may be a transformer that converts an alternating current to a direct current.

When the user chooses to ignite through the control panel 20, the controller 18 controls the ignition sensor pin 22 to generate a spark, and to keep sending the electric signal to the solenoid valve 144, so as to keep the solenoid valve 144 open. Then, the controller 18 controls the step motor of the flow-regulating valve 12 to make the valve plug 128 open the valve opening 122*a*, thereby allowing the fuel gas to enter the combustor 10 and generate flame. The blower 16 is also controlled to supply a proper volume of air to the combustor 10. The controller 18 then uses the ignition sensor pin 22 to sense whether the flame is present. If the flame exists, the spark-making operation is stopped. If the flame goes out, the controller 18 stops outputting the electric signal so as to make the solenoid valve 144 block the fuel gas.

When the user chooses firepower adjustment, the controller 18 controls the step motor 124 to change the degree of openness of the valve opening 122*a*, so as to increase or decrease the flow of the fuel gas supplied to the combustor 10. At the same time, the controller 18 controls the blower 16 correspondingly, so as to supply a proper volume of air to the combustor 10 and support good combustion.

When the user chooses to turn off the fire, the controller 18 stops outputting the electric signal to the solenoid valve 144, so as to cut off the supply of the fuel gas, and the controller 18 controls the step motor to close the valve opening 122*a*. At last, the blower 16 is stopped.

Figure 3:
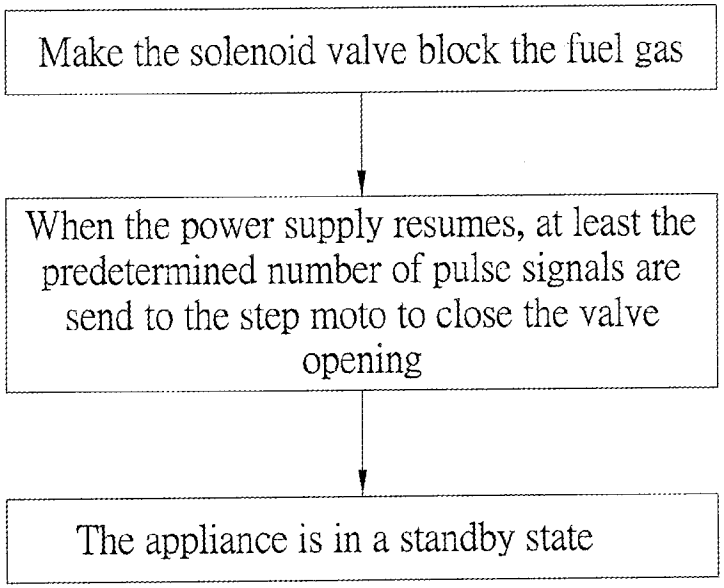
FIG. 3 is a flowchart of the method according to the first preferred embodiment of the present invention.

During combustion of the fuel gas, whenever the power source fails, the method shown in FIG. 3 is performed as below.

First, since the power source 24 no more supplies power, the controller 18 can't output the electric signal to the solenoid valve 144 anymore. Therefore, the solenoid valve 144 automatically blocks the fuel gas, and this prevents the fuel gas from keeping flowing and leaking out.

When the power supply of the power source 24 resumes, the controller 18 is reactivated and then sends at least the predetermined number of pulse signals to the step motor 124, so as to ensure that the valve plug 128 moves to a position where the valve opening 122*a* is closed. Afterward, the appliance is in a standby state and ready for the user to make ignition.

Thereby, the fuel gas is prevented from immediately enter the combustor 10 when ignition is made and the solenoid valve 144 is open after power restoration. Additionally, since the controller 18 closes the valve opening 122*a* when reactivated, the valve opening 122*a* is set into its initial state. Thus, during every first ignition after power restoration, the controller 18 can make the valve opening 122*a* remain the same level of openness by sending a constant number of said pulse signals to the step motor 124, so to achieve more convenient control after power restoration.

Figure 4:
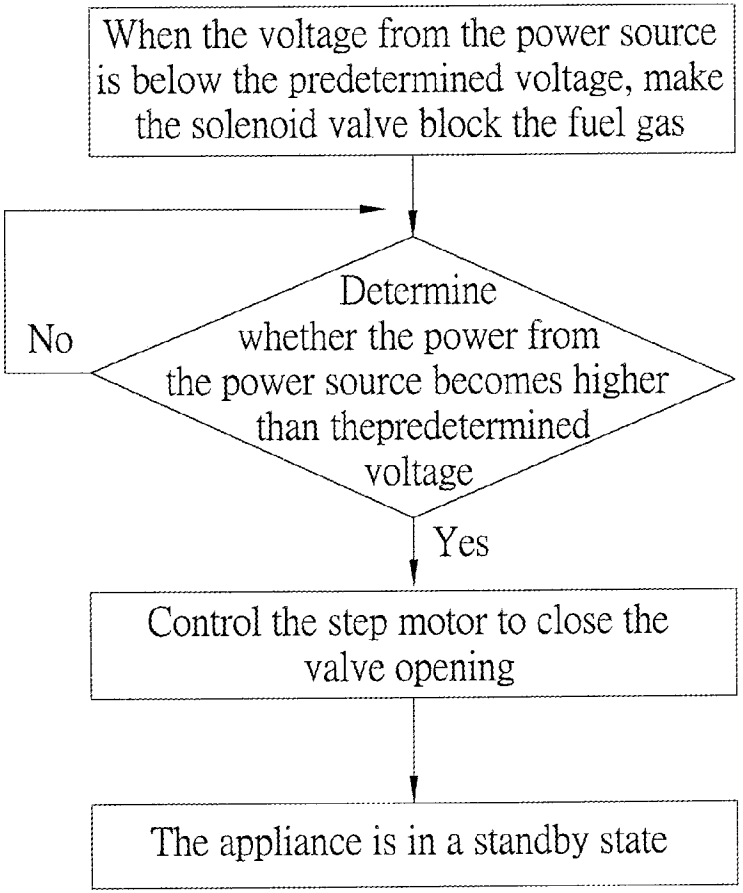
FIG. 4 is a flowchart of the method according to a second preferred embodiment of the present invention.

FIG. 4 is a flowchart of a method according to a second preferred embodiment of the present invention. In the present embodiment, the method uses a gas stove similar to that described in the first embodiment. Different from the first embodiment, the controller 18 herein further has a voltage detecting unit (not shown). The voltage detecting unit serves to detect the voltage of the power source 24. The controller 18 is programmed with a predetermined voltage. The predetermined voltage is the minimum voltage that is required to drive the motor 124.

In the present embodiment, the method is to be performed when the combustor 10 burns the fuel gas.

When the voltage from the power source 24 is below the predetermined voltage, the controller 18 stops sending the electric signal to the solenoid valve 144, so as to make the solenoid valve 144 blocks the fuel gas.

Afterward, the controller 18 determines whether the power from the power source 24 becomes higher than the predetermined voltage from the previous state where it is below the predetermined voltage.

If it is the case, the controller 18 sends at least the predetermined number of pulse signals to the step motor 124, so as to keep the valve plug 128 closing the valve opening 122*a*.

If it is not the case, the solenoid valve 144 keeps blocking the fuel gas.

The previous step will be repeated until the power from the power source 24 becomes higher than the predetermined voltage again. At this time, the valve opening 122*a* is closed and the appliance is in a standby state where it is ready for the user to ignite fire.

In this manner, it is possible to stop the supply of the fuel gas when the power from the power source 24 is too low to activate the step motor 124, and to close the valve opening 122*a* when the power from the power source 24 becomes higher than the predetermined voltage again.

Figure 5:
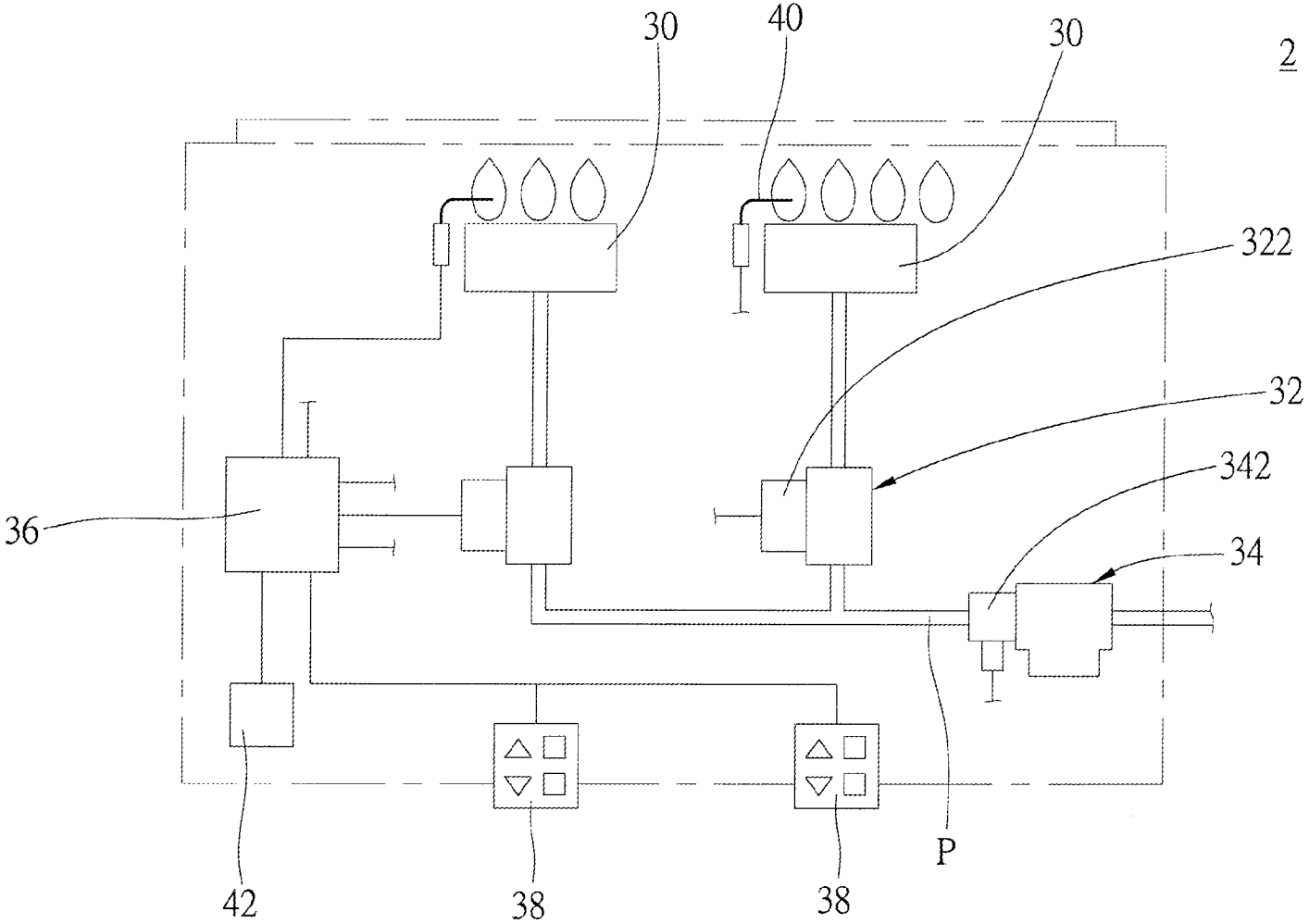
FIG. 5 is a schematic drawing showing the gas-fired appliance according to a third preferred embodiment of the present invention.

FIG. 5 schematically depicts a gas-fired appliance according to a third preferred embodiment of the present invention. In the third preferred embodiment, the gas-fired appliance is a gas roaster 2, which is basically the same with the gas stove 1 mentioned in the first embodiment, except that the gas roaster 2 has two combustors 30, two flow-regulating valves 32, a pressure regulator 34, and a controller 36.

The two combustors 30 communicate with the two flow-regulating valves 32, respectively. The two flow-regulating valves 32 are connected to the pressure regulator 34 through a pipeline P. The controller 36 is electrically connected to two control panels 38, two ignition sensor pins 40, step motors 322 of the flow-regulating valves 32, and a solenoid valve 342 of the pressure regulator 34.

The gas roaster 2 is provided with a power source 42 for powering the controller 36, the control panel 38, the ignition sensor pin 40, the step motors 322, and the solenoid valve 342.

By operating the control panels 38, a user can individually control ignition, firepower adjustment and turning off fire of the combustors 30. When the user ignites fire on one of the combustors 30, the controller 36 opens the solenoid valve 342, and makes the corresponding flow-regulating valve 32 to open its valve opening. Then when the user ignites fire on the other combustor 30, the corresponding flow-regulating valve 32 is controlled to open its valve opening.

The method of the present embodiment is to be performed when the power supplied by the power source 42 is cut off. It includes steps similar to those of the first embodiment, except that after the power of the power source 42 resumes, the controller 36 sends at least the predetermined number of pulse signals to the two step motors 322, respectively, so as to ensure that the valve plug of each of the flow-regulating valves 32 moves to close its valve opening.

Since the two flow-regulating valves 32 are connected to the same pressure regulator 34, the method of the present embodiment can ensure that during a standby state after power restoration, the valve openings of the two flow-regulating valves 32 are both closed. Thus, when one of the combustors 30 is operated for ignition, the fuel gas is prevented from leaking out from the other combustor 30.

The gas roaster 2 of the third embodiment can be used to implement a method according to a fourth embodiment of the present invention. The method of the fourth embodiment is similar to that of the second embodiment for that its controller 36 also has a voltage detecting unit and is programmed with a predetermined voltage, but has the following differences.

When the controller 36 determines that the power from the power source 42 becomes higher than the predetermined voltage from the previous state where it is below the predetermined voltage, the controller 36 sends at least the predetermined number of pulse signals to the two step motors 322, respectively, so as to close the valve openings of the flow-regulating valves 32. In this manner, it is possible to ensure when the power from the power source 42 becomes higher than the predetermined voltage again and the appliance enters its standby state, the valve openings of the two flow-regulating valves 32 are both closed. When one of the combustors 30 is operated for ignition, the fuel gas is prevented from leaking out from the other combustor 30.

While the previous embodiments are described against gas-fired appliances that fire natural gas, the present invention is not limited thereto. In other embodiments, gas-fired appliances firing other combustible gases such as hydrogen or acetylene may be also employed to be applied with the present invention.

In summary, the disclosed method for controlling a gas-fired appliance ensures that when the power from power source becomes normal after power failure or low power, the valve opening is closed so as to facilitate subsequent controls. Besides, when the solenoid valve is open during next ignition, the fuel gas is prevent from flowing into the combustor immediately.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A method for controlling a gas-fired appliance, wherein the gas-fired appliance includes a combustor, at least one flow-regulating valve and a solenoid valve, wherein the at least one flow-regulating valve and the solenoid valve are installed on a pipeline which communicates with the combustor and serves to introduce fuel gas; wherein each of the at least one flow-regulating valve has a valve body, a valve plug, and a motor, wherein the valve body has a valve opening for the fuel gas to pass therethrough, and the valve plug is drivable by the motor to change a degree of openness of the valve opening; the solenoid valve is controllable to allow or disallow the fuel gas to pass therethrough; and the gas-fired appliance further includes a power source for powering the motor;

wherein the method is activated when the power source stops supplying power, by adaptively performing the steps comprising of:

using the solenoid valve to block the fuel gas from passing therethrough; and when the power source starts to supply the power again, controlling the motor to make the valve plug close the valve opening.

2. The method of claim 1, wherein the motor is a step motor that receives a predetermined number of pulse signals so as to drive the valve plug to make the degree of openness of the valve opening change from where the valve opening is fully open to where the valve opening is closed; when the power source starts to supply the power again, at least the predetermined number of pulse signals are send to the motor by a controller, so as to make the valve plug close the valve opening.

3. The method of claim 1, wherein the solenoid valve is a normally closed solenoid valve, and the power source further powers the solenoid valve; when the power source stops supplying the power, the solenoid valve automatically cuts off the fuel gas.

4. A method for controlling a gas-fired appliance, wherein the gas-fired appliance includes a combustor, at least one flow-regulating valve, and a solenoid valve, wherein the at least one flow-regulating valve and the solenoid valve are installed on a pipeline which communicates with the combustor and serves to introduce fuel gas; each of the at least one flow-regulating valve has a valve opening, a valve plug, and a motor, wherein the valve opening allows the fuel gas to pass therethrough, and the valve plug is drivable by the motor to change a degree of openness of the valve opening; the solenoid valve is controllable to allow or disallow the fuel gas to pass therethrough; and the gas-fired appliance further includes a power source for powering the motor; wherein the method is activated when the power source stops supplying power, by adaptively performing the steps comprising of:

A. when a power supplied by the power source is below a predetermined voltage, activating the solenoid valve to disallow the fuel gas to pass therethrough;

B. determining whether the power supplied by the power source exceeds the predetermined voltage to thereby controlling the motor to make the valve plug close the valve opening when the power source exceeds the predetermined voltage; and activating the solenoid valve to thereby disallow the fuel gas to pass therethrough when the power source is below the predetermined voltage; and C. repeating Step B until the valve plug closes the valve opening.

5. The method of claim 4, wherein the predetermined voltage is a minimum voltage that is required to drive the motor.

6. The method of claim 5, wherein the motor is a step motor which receives a predetermined number of pulse signals so as to drive the valve plug to change the degree of openness of the valve opening from where the valve opening is fully open to where the valve opening is closed; when the power supplied by the power source becomes higher than the predetermined voltage again, at least the predetermined number of pulse signals are sent to the motor by a controller, so as to make the valve plug close the valve opening.

7. The method of claim 4, wherein the solenoid valve is a normally closed solenoid valve, and the power source further powers the solenoid valve; wherein the power source stops supplying the power, the solenoid valve automatically cuts off the fuel gas.

* * * * *